United States Patent [19]

Lill et al.

[11] Patent Number: 4,886,029

[45] Date of Patent: Dec. 12, 1989

[54] IGNITION MISFIRE DETECTOR

[75] Inventors: Mark P. Lill, Bensenville; Edward E. Li, Roselle; Koushun Sun, Hoffman Estates, all of Ill.

[73] Assignee: Motorola Inc., Schaumburg, Ill.

[21] Appl. No.: 198,908

[22] Filed: May 26, 1988

[51] Int. Cl.[4] ..... F02P 11/06; F02D 41/22

[52] U.S. Cl. ..... 123/479; 123/630; 73/117.3; 324/380

[58] Field of Search ..... 123/198 D, 198 DB, 478, 123/479, 481, 630; 60/277; 73/115, 116, 117.3; 324/380, 391, 399

[56] References Cited

U.S. PATENT DOCUMENTS

| | | | |
|---|---|---|---|
| 3,882,840 | 5/1975 | Adamian et al. | 123/644 |
| 3,924,457 | 12/1975 | Oshima et al. | 60/277 X |
| 4,024,850 | 5/1977 | Peter et al. | 123/198 DB X |
| 4,040,294 | 8/1977 | Matsuda et al. | 73/117.3 |
| 4,083,234 | 4/1978 | Aono et al. | 60/277 X |
| 4,114,582 | 9/1978 | Rabus et al. | 123/650 |
| 4,117,807 | 10/1978 | Barnard | 123/478 |
| 4,181,113 | 1/1980 | Ruf et al. | 123/630 |
| 4,312,043 | 1/1982 | Frank et al. | 324/391 X |
| 4,380,989 | 4/1983 | Takaki | 123/644 |
| 4,449,100 | 5/1984 | Johnson et al. | 324/378 |
| 4,556,040 | 12/1985 | Heyke | 123/643 |
| 4,567,755 | 2/1986 | Ootsuka et al. | 73/117.3 |
| 4,602,507 | 7/1986 | Hayes | 73/117.3 |
| 4,661,778 | 4/1987 | Anderson | 324/380 |

*Primary Examiner*—Willis R. Wolfe

*Attorney, Agent, or Firm*—John H. Moore

[57] ABSTRACT

A technique for detecting misfire due to a fault in the secondary of an automotive ignition system compares the ignition signal developed by the ignition coil, preferably the primary winding thereof, to reference signals. Abnormal results which occur at predetermined times subsequent to the initiation of the ignition signal indicate short circuit and/or open circuit conditions in the ignition system's secondary. In response to such fault conditions, fuel is preferably shut off to the cylinder associated with the misfire.

23 Claims, 4 Drawing Sheets

OUTPUT
82
80
84
85
P.U.
78
76
86
62
102
3.5V
100
106
64
0.1V
I S
40
98
96
94
93
104
30 μ SEC. DELAY
60
120 μ SEC. DELAY
88
3.5V
92
50
52
54
58
90
56
V BATT.
44
42
46
TO SPARK PLUGS
ENGINE CONTROL MODULE
48

TO ENGINE CONTROL MODULE
124
M.C.
120
107
122
116
118
P.U.
114
E
108
110
50
112
FROM TERMINAL 93
FROM TERMINAL 82

66
I S
74
72
70
V BATT.
44
68

IGNITION MISFIRE DETECTOR

FIELD OF THE INVENTION

This invention is generally directed to ignition systems for internal combustion engines, and more particularly to techniques for sensing spark plug misfire in such an engine.

BACKGROUND OF THE INVENTION

Typical engine control systems for automobiles generate a spark control signal which is used to initiate the charging and discharging of an ignition coil. At the proper time, the high voltage generated by the ignition coil causes a spark plug to fire and ignite the fuel in its associated cylinder.

The same engine control system may also include a diagnostic section that senses the initial charging of the ignition coil to confirm that a spark control signal was generated, and that the ignition coil was responding by beginning to charge.

While such diagnostics are useful, they do not sense other types of ignition malfunctions. Specifically, they do not detect the type of spark plug misfire which can occur even though the ignition coil has been properly charged.

Spark plug misfires can occur due to a faulty spark plug, an open plug wire, a short circuit in the ignition system, or the like. When the misfire happens, unburnt fuel travels from the engine to the catalytic converter, causing the temperature of the catalyst to rapidly increase to an undesirably high level. In addition, the unburnt fuel removes oil from the sides of the piston associated with the misfiring spark plug, thus promoting increased wear. Poorer mileage also results.

Accordingly, it is a general object of the invention to provide an improved method and apparatus for detecting spark plug misfire so as to overcome the shortcomings discussed above.

It is a more specific object of the present invention to provide a technique and a circuit for reliably sensing spark plug misfire due to open circuits and/or short circuits in the secondary of an automotive ignition system, and for optionally shutting down the flow of fuel to the cylinder that is misfiring.

DESCRIPTION OF THE PREFERRED EMBODIMENT

The present invention will normally be used with an engine whose ignition system includes at least one ignition coil having a primary winding and a secondary winding. The primary winding develops a primary current in response, for example, to an engine control module that switches the primary coil alternately between a relatively high potential and a relatively low potential. This operation causes the secondary winding to develop a high voltage that is applied to the engine's spark plugs.

If an open circuit or a short circuit develops in the secondary of the ignition system, one or more of the spark plugs is likely to misfire. Conditions which give rise to such misfire are detected by the present invention, and provision is made for shutting off the flow of fuel to a misfiring cylinder.

Figure 1:
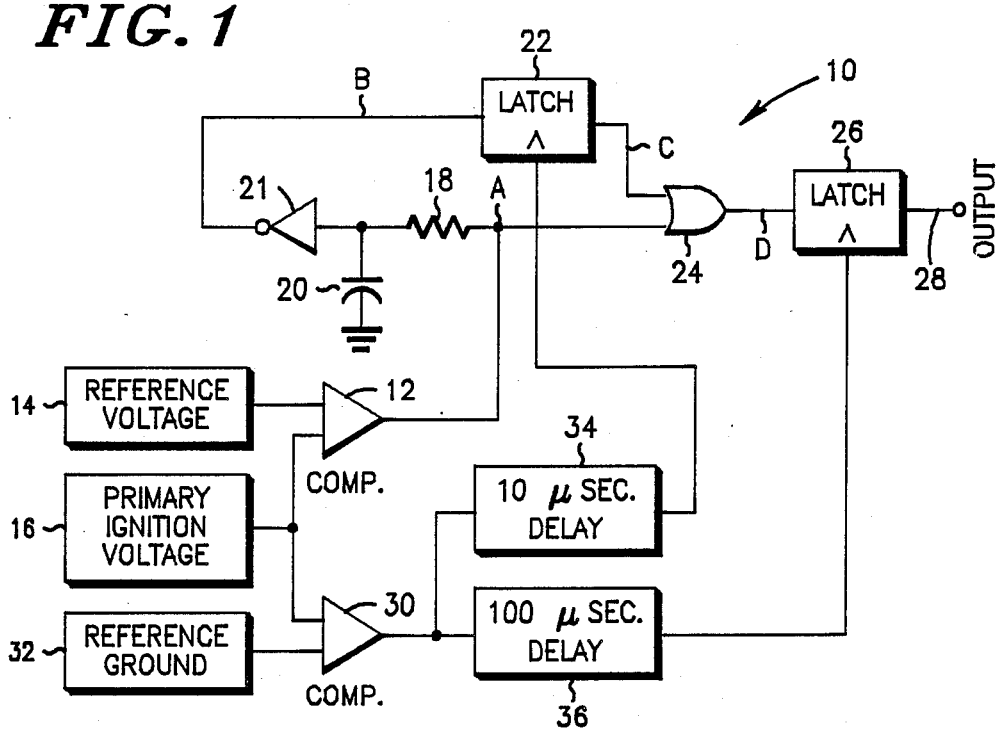
FIG. 1 is a schematic diagram of an electronic circuit, according to one embodiment of the invention, for detecting misfire in an internal combustion engine.

Referring now to FIG. 1, a circuit 10 is shown for detecting and signaling the occurrence of misfire in an internal combustion engine. According to one aspect of the invention, the circuit 10 operates, in part, bY sensing the signal developed by the primary winding of the ignition coil (the primary signal), comparing the sensed primary signal to a reference signal to develop a control signal, integrating the control signal, and indicating a misfire condition when the integrated control signal exhibits an abnormal value a first predetermined interval after the initiation of the primary ignition signal. In the particular embodiment 10 shown in FIG. 1, the primary signal that is sensed is the voltage developed by the primary winding of the ignition coil (the primary ignition voltage), and one misfire condition which is detected is a short in the secondary of the ignition system, such as when the secondary of the ignition coil is shorted. A misfire caused by an open circuit in the ignition system's secondary is also detected by the embodiment of FIG. 1 by comparing the sensed signal (the primary ignition voltage) to the same or a different reference signal a second, longer, predetermined interval after the initiation of the primary signal.

As shown in FIG. 1, the circuit 10 includes a comparator 12 which receives a reference voltage from block 14. In the illustrated circuit, the value of the reference voltage is selected such that it is equal to the value that the primary ignition voltage normally attains a first predetermined interval (10 microseconds, for example) after initiation of the primary ignition voltage. Another input to the comparator 12 is the primary ignition voltage, as represented by the block 16. If necessary, the primary ignition voltage may be filtered by an R-C filter before being coupled to the comparator 12.

The output of the comparator 12 is coupled to a node A which couples to an integrator comprising a resistor 18 and a capacitor 20. An inverter 21 couples the integrator to the input of a conventional latch 22 via a lead B. The output of the latch 22 is coupled via lead C to one input of an OR gate 24. The output of the OR gate 24 is coupled via lead D to the input of another conventional latch 26. The output terminal 28 of the latch 26 is where a "misfire" signal is generated when a misfire is detected.

The primary ignition voltage from block 16 is also coupled to one input of a comparator 30. The other input to the comparator 30 is coupled to a reference potential such as ground, as indicated by block 32. The output of the comparator 30 is a "start" signal which indicates the initiation of the primary ignition voltage.

The start signal generated by the comparator 30 is coupled to the inputs of two conventional time delay circuits, a 10 microsecond delay circuit 34 that is used in the detection of short circuits in the ignition system, and a 100 microsecond delay circuit 36 that is used in the detection of open circuits in the ignition system.

The output of the delay circuit 34 is coupled to the trigger input of the latch 22. Consequently, when the delay circuit 34 supplies a delayed "start" signal to the latch 22, the signal level (high or low) on the lead B will be latched onto the lead C. In like manner, the output of the delay circuit 36 couples a delayed "start" signal to the trigger input of the latch 26, whereupon the signal level (high or low) on the lead D is latched to the output terminal 28.

The operation of the circuit 10 will now be described with reference to the waveforms illustrated in FIGS. 2, 3 and 4. The waveform A in the latter figures corresponds to the signal at node A in FIG. 1, the waveforms B-D correspond to the signals developed on leads B-D in FIG. 1, and the "output" Waveform corresponds to the signal developed at the output terminal 28.

Figure 2:
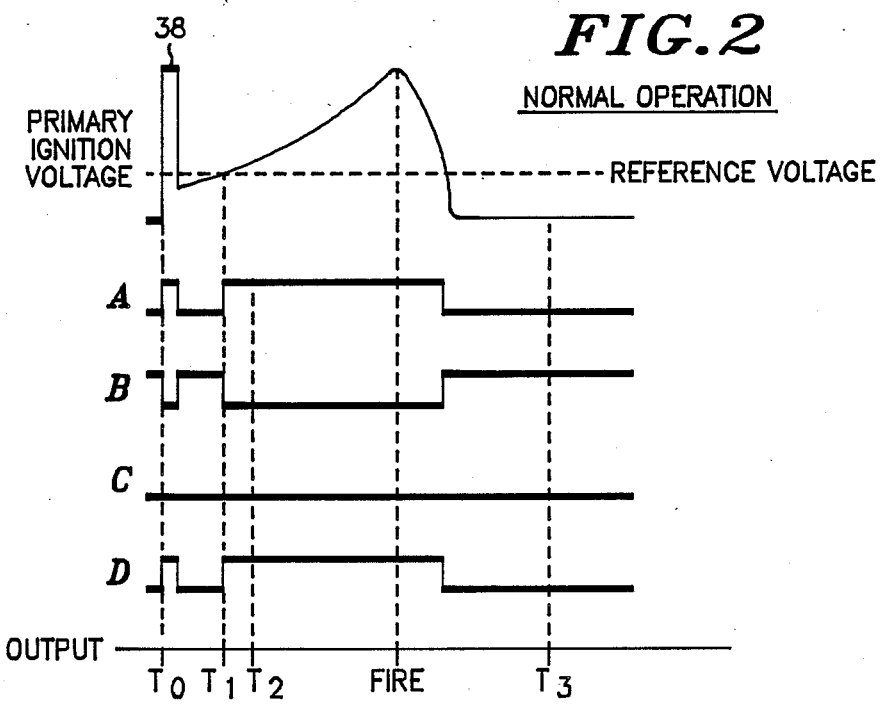
FIG. 2 illustrates waveforms depicting the operation of the circuit shown in FIG. 1 when the engine's ignition system is operating normally.

With reference to FIG. 2, the primary ignition voltage (from block 16) is shown (in somewhat idealized fashion) as it is developed during normal operation of the ignition system, i.e., with no short circuits or open circuits in the ignition system that could contribute to spark plug misfire. At time T0, the current through the ignition coil is turned off so that a relatively high voltage is generated across its primary winding due to the leakage inductance in the primary of the coil, thus producing the narrow pulse 38. Because the primary ignition voltage now exceeds ground potential, the output of the comparator 30 goes high to produce a "start" signal which is applied to the two delay circuits 34 and 36. The primary ignition voltage developed at TO also exceeds (temporarily) the reference voltage 14, which results in the output of comparator 12 (node A) going high. When the capacitor 20 becomes sufficiently charged the inverter 21 drives the lead B low. Also, the OR gate 24 drives the lead D high because its input from node A is high. The only real event of significance resulting from the primary ignition voltage going high at time T0 is that the "start" pulse was generated by the comparator 30.

Referring to FIG. 2 again, the primary ignition voltage begins rising normally after the termination of the pulse 38 until it eventually again reaches the level of the reference voltage 14 at time T1, whereupon the comparator 12 once again drives the signal at node A high. When the capacitor 20 becomes sufficiently charged, the inverter 21 drives the signal on lead B low while the OR gate 24 drives lead D high. The condition of the signals at these various points in the circuit are maintained until time T2, at which point the circuit 10 begins to look for a short circuit condition. The delay 34 now outputs the delayed "start" pulse Which triggers the latch 22. This causes the level of the signal on lead B to be latched onto lead C which, in this case, means maintaining the signal on lead C at a low level as shown by the waveform in FIG. 2. A low level on lead C after time T2 indicates that no short circuit condition was found.

After the time T2, the primary ignition voltage keeps rising, as shown, until the ignition system causes a spark plug to fire, at which time (indicated as "fire") the amplitude of the primary ignition voltage starts to drop. This causes the level of the primary ignition voltage to soon drop below the level of the reference voltage 14, whereupon the comparator 12 drives the signal at node A low. As a result, the OR gate 24 also drives the level of the signal at lead D low. The level of the signal on lead C remains constant because it has been latched low by the latch 22.

After the amplitude of the primary ignition voltage drops below the reference voltage, the signal levels at points A-D in the circuit 10 remain constant until the time T3. At T3, the circuit 10 looks for an open circuit condition in the ignition system by again comparing the primary ignition voltage to the reference voltage. For that purpose, the delay 36 outputs a delayed "start" pulse which is applied to the trigger input of the latch 26. This causes the latch 26 to latch the output terminal 28 to the same signal level which appears on lead D. Because the signal on lead D is now low, the output signal at the terminal 28 also remains low, thus signifying that the ignition system is operating normally.

From the foregoing description, it is clear that the voltage on the lead D must be high at time T3 in order to generate a high level misfire signal at the output terminal 28. This condition only occurs when the circuit 10 senses either a short circuit or an open circuit in the secondary of the ignition system as now will be explained more fully with reference to FIG. 3.

Figure 3:
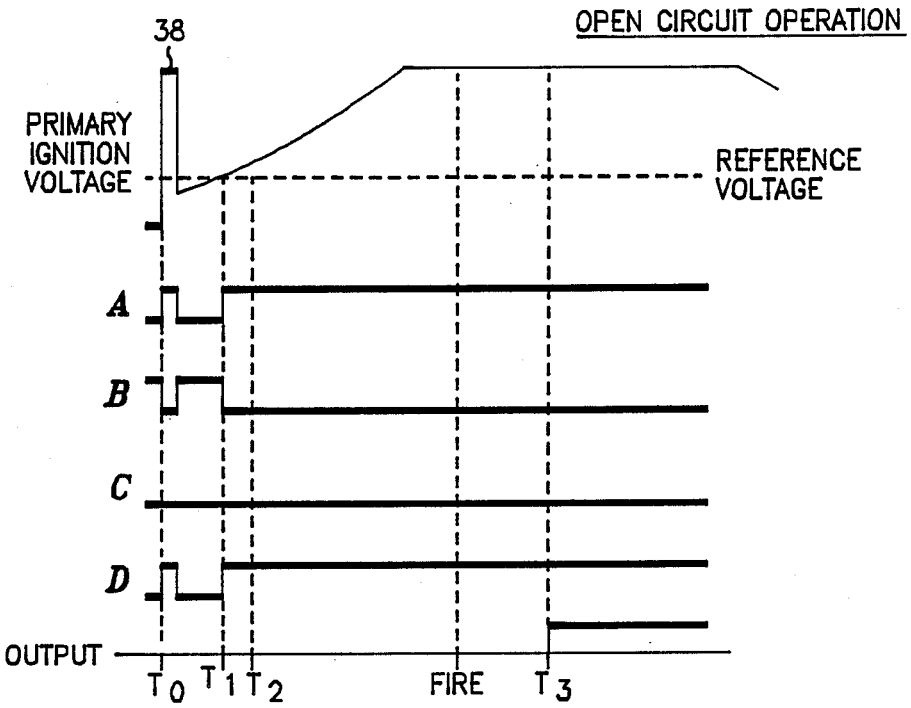
FIG. 3 illustrates the same waveforms as shown in FIG. 2, except that the FIG. 3 waveforms illustrate the situation in which the engine is experiencing misfire due to an open circuit condition in the secondary of the ignition system.

As shown in FIG. 3, the primary ignition voltage again produces the pulse 38 at time TO, as explained previously. The only significant result of that pulse is that the comparator 30 outputs a "start" pulse which is coupled to the delaY circuits 34 and 36.

After the pulse 38 terminates, the primary ignition voltage begins rising as before until it once again reaches or exceeds the level of the reference voltage 14 at time T1. When that occurs, the comparator 12 again drives the node A high as illustrated in FIG. 3. Consequently, the OR gate 24 drives the lead D high, and, when the capacitor 20 becomes sufficiently charged, the inverter 21 drives the lead B low.

The primary ignition voltage continues to rise normally until, at time T2, the delay circuit 34 triggers the latch 22, whereupon the low level appearing on lead B is latched to lead C. These conditions continue, as illustrated by the waveforms in FIG. 3, until the primary ignition voltage reaches a high, substantially constant level at which it is usually clamped. It remains at that level until the spark plug firing time occurs.

Because there is now an assumed open circuit condition in the ignition system secondary (such as an open plug wire or the like), the voltage developed across the secondary winding of the ignition coil does not collapse. Further, the primary ignition voltage also remains high and cannot decrease as it normally would upon the occurrence of a spark plug firing. Consequently, the primary ignition voltage remains high until and beyond time T3, at which point the 100 microsecond delay circuit 36 triggers the latch 26. Because the comparator 12 did not drive node A low when the "fire" time occurred, node A and lead D remained high.

With a relatively high level signal on the lead D, the latch 26 now latches the output terminal 28 to a high level, thereby signaling a misfire condition.

Figure 4:
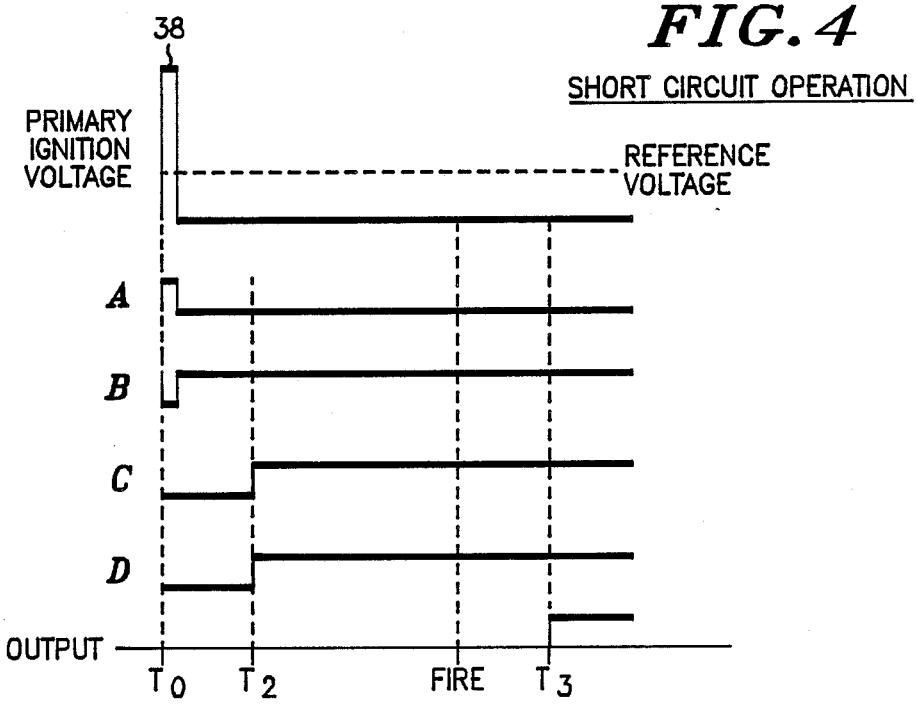
FIG. 4 illustrates the same waveforms as shown in FIG. 2, except that the FIG. 4 waveforms illustrate the situation in which the engine is experiencing misfire due to a short circuit in the secondary of the ignition system.

Turning now to FIG. 4, the operation of the circuit 10 will be described under conditions involving a short circuit in the secondary of the ignition system. As shown by the waveform illustrating the primary ignition voltage, a short circuit in the ignition system's secondary (such as a short across the secondary of the ignition coil) results in the pulse 38 being generated as usual. Beyond the time T0, the primary ignition voltage remains near ground. The occurrence of the pulse 38 once again causes the comparator 30 to issue a "start" signal which is applied to the delay circuits 34 and 36. After the termination of the pulse 38, the signal on the lead A is low while the level of the signal on lead B is high. Consequently, when the time T2 occurs upon the expiration of the 10 microsecond delay, the latch 22 is triggered to latch the high level on lead B onto lead C. Because of this latching operation, the potential on lead C will remain high through the duration of the illustrated cycle, irrespective of any signal changes in the remainder of the circuitry. Between the times T2 and T3, the signal levels at node A and on leads B, C and D remain constant, as shown. At time T3, the 100 microsecond delay circuit 36 issues its delayed "start" signal to trigger the latch 26, whereupon the output terminal 28 is latched to a high level because of the high level now existing on the lead D. The high level generated at the output terminal 28 is a "misfire" signal which signifies that spark plug misfire is occurring due to the operation described.

The foregoing description illustrates how the ignition coil's primary ignition voltage is sensed and compared by the comparator 12 to the reference voltage from the block 14. If the comparison of the primary ignition voltage to the reference voltage exhibits an abnormal relationship and that abnormality continues long enough to charge the capacitor 20 at the end of a first predetermined interval (provided by the 10 microsecond delay 34) after the initiation of the primary ignition voltage, then a misfire condition is signaled by driving the output terminal 28 high. The primary ignition voltage is also compared to the reference voltage at a second predetermined interval (as established by the 100 microsecond delay 36), and another misfire signal is generated when the comparison reveals an abnormal relationship between a reference voltage and the primary ignition voltage. For example, FIG. 2 shows that, under normal operating conditions, the primary ignition voltage exceeds the reference voltage from block 14 at time T2. This is a normal condition. Again at time T3, the primary ignition voltage should normally be lower than the reference voltage. Contrast these conditions to the situations exhibited in FIGS. 3 and 4. Referring to FIG. 3 first, the open circuit condition illustrated therein shows that at time T3, the amplitude of the primary ignition voltage exceeds the reference voltage. This abnormal relationship between these two voltages causes the signal at node A and the signal on lead D to be at a high level at time T3, thus causing the high level on lead D to be latched to the output terminal 28, thereby signaling a misfire condition.

In FIG. 4, the primary ignition voltage is less than the reference voltage at time T2. This abnormal condition causes the voltage on lead B to be high at time T2, whereupon that high level is latched to the lead C at time T2 and is held there until time T3 when the latch 23 is triggered to drive the output terminal 28 high in response to the high level on the lead D. This signals a misfire condition.

A further comment is appropriate regarding the integrator (FIG. 1) comprising the resistor 18 and the capacitor 20. Although the waveforms shown in FIGS. 2, 3 and 4 indicate that the voltage on the lead B changes simultaneously with the voltage on the lead A, the fact is that the voltage input to the inverter 21 lags the voltage at node A to an extent which depends on the time constant associated with the integrator. This allows spurious and/or intermittent variations in the value of the voltage at node A to be ignored by the inverter 21, thereby preventing a false indication of a misfire.

Figure 5:
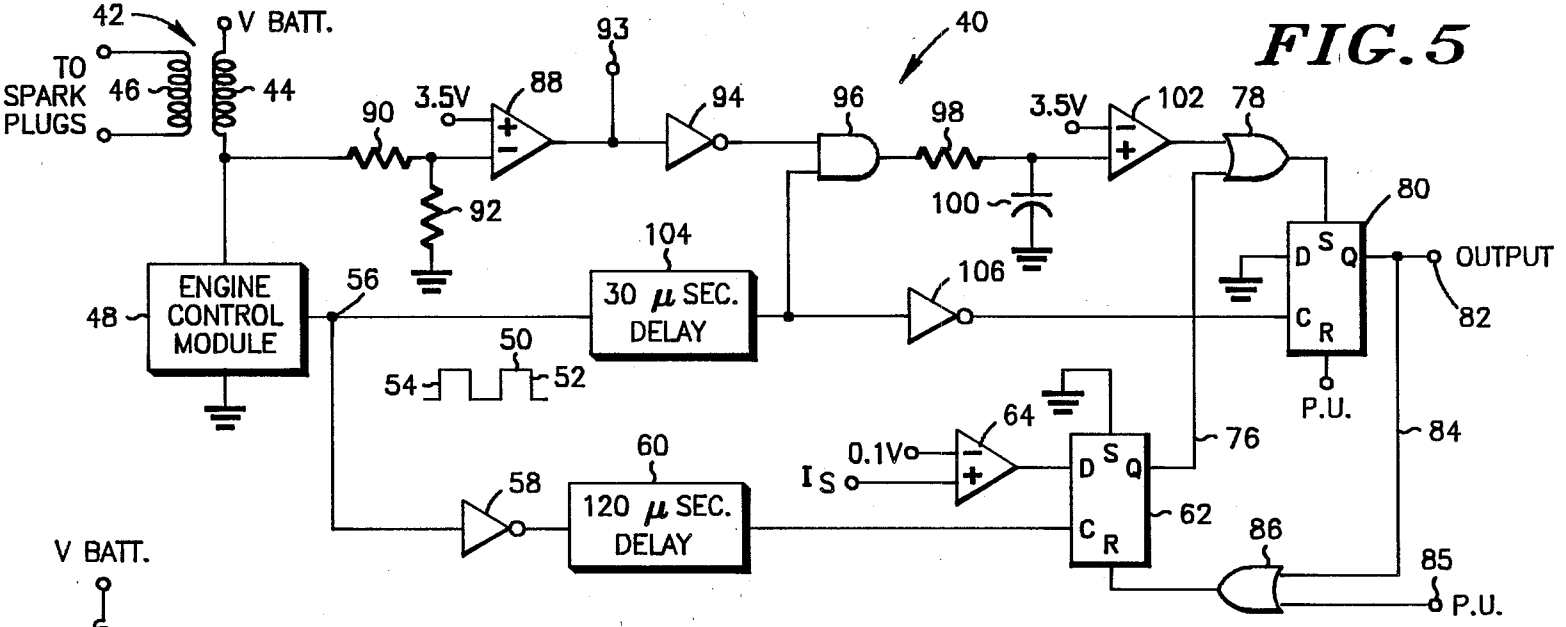
FIG. 5 is a schematic diagram of another embodiment of the invention.

Referring now to FIG. 5 another circuit 40 is shown for detecting misfire conditions according to the invention. The circuit 40 operates similarly to the circuit shown in FIG. 1 in that the relative amplitude of the primary ignition signal is sensed at two different predetermined times in order to detect short circuits and open circuits in the secondary of the ignition system.

The circuit 40 is shown connected to an ignition coil 42 that has a primary winding 44 and a secondary winding 46. The voltage developed by the secondary winding 46 is coupled to spark plugs in the conventional matter.

An engine control module 48 is coupled to one end of the primary winding 44, the other end of which is connected to a positive battery potential. The module 48 conventionally develops a train of pulses as shown at 50 wherein each pulse has an edge 52 which initiates the flow of current through the primary winding and another edge 54 that shuts off the current to initiate the development of the high voltage needed to fire the spark plugs. The edge 54 occurs at the time T0 shown in FIGS. 2–4. With this arrangement, the primary winding 44 develops a primary ignition voltage such as shown in FIGS. 2, 3 and 4.

The operation of the circuit 40 Will now be described under conditions in which the ignition system's secondary is shorted and the primary winding 44 develops an ignition voltage such as shown in FIG. 4. The pulse train 50, in addition to controlling the switching time of the primary winding 44, is also applied to an input terminal 56 which is coupled to the input of an inverter 58. The output of the inverter 58 is coupled to a conventional delay circuit 60 which, in the illustrated embodiment, introduces a delay of 120 microseconds. The output of the delay circuit 60 is coupled to the clock input of a conventional flip-flop 62. The phase inversion due to the inverter 58, and the delay introduced by the circuit 60, cause the flip-flop 62 to be clocked 120 microseconds after the flow of current is started in the primary winding 44. Thus, circuit 40 looks for a short circuit condition during the time when current is normally flowing in the primary winding 44. In contrast, the embodiment shown in FIG. 1 looks for a short circuit condition after the current path to the primary winding has been switched off. Both circuits, however, compare a primary ignition signal (current or voltage) to a reference some predetermined interval after initiation of the primary ignition signal.

The D input of the flip-flop 62 is coupled to the output of a comparator 64. This comparator receives, at its inverting input terminal, a reference voltage which, for this embodiment, may be 0.1 volt. The non-inverting input to the comparator 64 is a signal $I_s$ which is proportional to the current in the primary winding 44.

Figure 6:
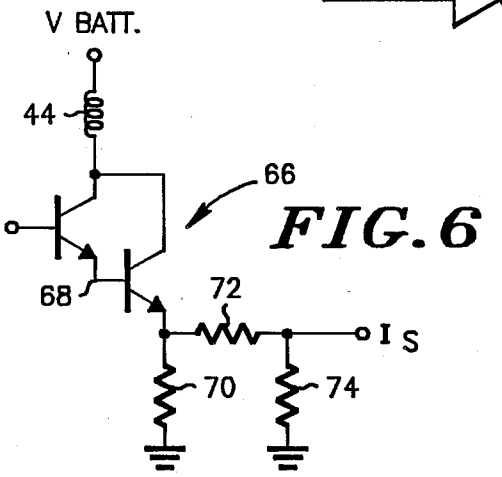
FIG. 6 is a schematic diagram of a circuit for developing the Is signal which forms one input to the circuit shown in FIG. 5.

Turning briefly to FIG. 6, a circuit 66 is shown which illustrates how the signal $I_s$ may be developed. As shown, a Darlington transistor arrangement 68 has its collector coupled to the primary winding 44. This Darlington normally would be included within the engine control module 48 (FIG. 5). The emitter of the Darlington 68 is coupled to a emitter resistor 70 and to a voltage divider comprising resistors 72 and 74. At the junction of the resistors 72 and 74, the signal (voltage) $I_s$ is developed such that $I_s$ varies in proportion to the magnitude of the current in the primary winding 44.

Returning again to FIG. 5, the amplitude of the signal $I_s$ is compared to the reference voltage applied to the other input of comparator 64. If the secondary winding 46 of the ignition coil 42 is shorted, the equivalent inductance in the primary winding 44 will be substantially reduced, thereby permitting the primary winding to charge very rapidly.

When the 120 microsecond delay expires, the output of the delaY 60 clocks the flip-flop 62. Because of the short circuit condition, the current in the primary winding 44 at that time will greatly exceed the normal level of current in the primary winding. Hence, the output of the comparator 64 will be high and that high level will be clocked to the Q output of the flip-flop 62, thus indicating that a fault condition has been detected. The Q output of the flip-flop 62 is coupled via a lead 76 to one input of an OR gate 78, the output of which is coupled to the set input of another conventional flip-flop 80. The Q output of the flip-flop 80 is coupled to an output terminal 82 which constitutes the ultimate output of the circuit 40. Accordingly, the high level signal on the lead 76 from flip-flop 62, which was coupled through the OR gate 78 to the set input of the flip-flop 80, causes the signal level on terminal 82 to go high to signal a misfire condition. The Q output of flip-flop 80 is also coupled via a lead 84 to one input of an OR gate 86, the output of which resets the flip-flop 62. A power-up (P.U.) signal, generated conventionally when the ignition system is turned on, is applied to the other input 85 of the OR gate 86. The same P.U. signal is applied to the reset input of the flip-flop 80.

The operation of circuit 40 will now be described under the condition in which the ignition system exhibits an open circuit in the secondary of the ignition coil. The ignition voltage developed by the primary winding 44 is coupled to the inverting input of a comparator 88 via a voltage divider comprising resistors 90 and 92. The non-inverting input of the comparator 88 receives a reference voltage which, in this embodiment, is 3.5 volts. When the primary ignition voltage received by the comparator 88 exceeds the 3.5 volt reference voltage, the output of the comparator 88 goes low and is applied to the input of an inverter 94 and to an output terminal 93 which couples to the circuitry shown in FIG. 7 (discussed later). The resulting high level signal output by the inverter 94 is coupled to one input of an AND gate 96. The output of the AND gate 96 is coupled to an integrator comprising a resistor 98 and a capacitor 100, the latter being coupled to the non-inverting input of another comparator 102. The inverting input of comparator 102 receives another reference voltage which, in the illustrated embodiment, is 3.5 volts. It can be seen, therefore, that the comparator 102 compares the voltage on the capacitor 100 against the 3.5 volts reference, and outputs a high level signal whenever the voltage on the capacitor 100 exceeds 3.5 volts. That high level output signal is coupled to an input of the OR gate 78 for setting the flip-flop 80 under open circuit conditions.

The input terminal 56 which receives the pulse train 50 is also coupled to another delay circuit 104 which provides a 30 microsecond delay. The output of the delay circuit 104 is coupled to one input of the AND gate 96 and also to an inverter 106, the output of which is coupled to the clock input of the flip-flop 80.

With an open circuit in the secondary of the ignition system, the primary ignition voltage developed by the ignition coil 42 will be as shown in FIG. 3. After the normal spark plug fire time, the primary ignition voltage sensed by the comparator 88 will exceed the 3.5 volt reference voltage, whereupon the output of the comparator 88 will go low and the output of the inverter 94 will go high. If both inputs to the AND gate 96 are now high, the output of the AND gate 96 will also go high to charge the capacitor 100. However, the input to AND gate 96 from the delay circuit 104 does not go high for 30 microseconds after the initiation of the primary ignition voltage. The reason for this delay is as follows.

The voltage developed on the capacitor 100 is proportional to the length of time during which the sensed primary ignition voltage exceeds the 3.5 volt reference that is coupled to the comparator 88. During normal operating conditions (no fault), the voltage developed on the capacitor 100 will be at a relatively low level which will be referred to as V1. During open circuit conditions, the sensed primary voltage will exceed the 3.5 volt reference voltage for a much greater length of time, thereby permitting the capacitor 100 to charge for a longer period of time and, consequently, to charge to a higher voltage V2. The voltage ratio of V2/V1 can be defined as a signal-to-noise ratio. In order to improve that signal-to-noise ratio, the delay circuit 104 inhibits the AND gate 96 from charging the capacitor 100 until the pulse 38 (FIG. 4) has ended. This essentially allows a DC offset voltage to be subtracted from both V2 and from V1 (as defined above) because the pulse 38 is always present, and as V1 approaches a small value the signal-to-noise ratio is With the foregoing discussion in mind, it will be appreciated that the integrator comprising the resistor 98 and the capacitor 100 essentially develops a signal on the capacitor 100 that is representative of the energy associated with the ignition signal (with the first 30 microseconds deleted). That signal on the capacitor 100 is compared to another reference voltage received by the comparator 102. If the voltage on the capacitor 100 exceeds the 3.5 volt reference voltage, this is an indication that the energy associated with the primary ignition voltage is much higher than normal and is attributed to an open circuit condition in the secondary of the ignition system. Consequently the comparator 102 outputs a high level signal which the OR gate 78 uses to set the flip-flop 80, whereupon the signal at the output terminal 82 goes high to signify a misfire condition.

The misfire signal at the output terminal 82 may be used as a diagnostic signal, as a signal to alert the vehicle operator that a misfire condition exists, or as a signal that can be decoded to identify the misfiring cylinder and to shut down the delivery of fuel to that cylinder. The circuitry shown in FIGS. 7 and 9 uses the misfire signal for the last-mentioned purpose.

Figure 7:
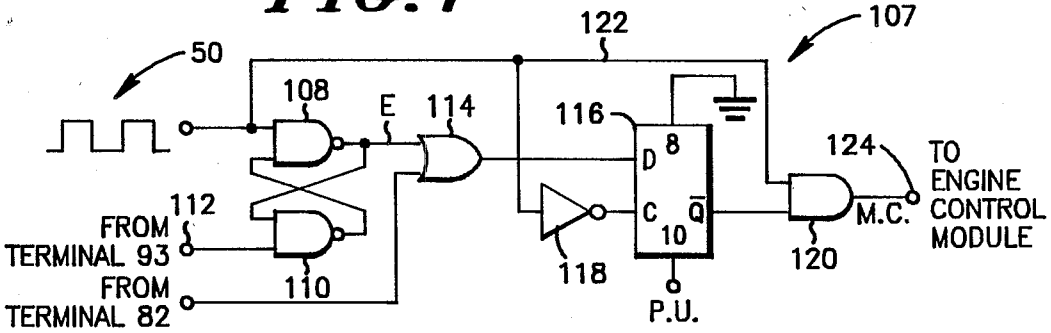
FIG. 7 shows a circuit which is responsive to inputs from the embodiment of FIG. 5 for developing an output signal that identifies a misfiring cylinder.
Figure 8:
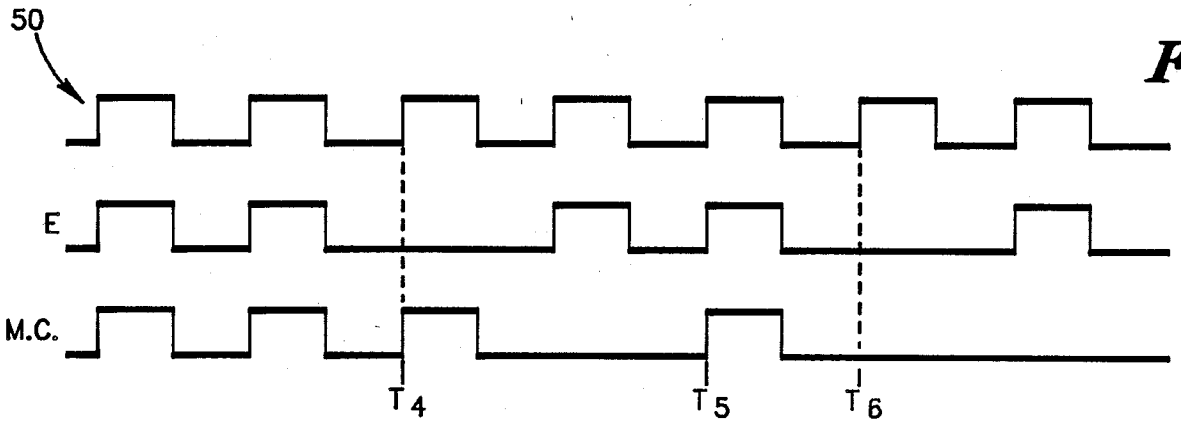
FIG. 8 shows waveforms associated with the operation of the circuit shown in FIG. 7.

In FIG. 7, a circuit 107 includes an AND gate 108 that receives the waveform 50, previously described, from the engine control module 48. Another AND gate 110, cross-coupled with the gate 108, has an input terminal 112 which receives the output of the comparator 88 via terminal 93 (FIG. 5). With this arrangement, gates 108 and 110 develop a signal E as shown in FIG. 8. When no pulses are missing from the signal E, the primary of the ignition system is operating properly. FIG. 8, discussed more fully below, shows the relationship between the waveform 50 and the signal E.

An OR gate 114 receives the signal E and the output signal from the circuit 40 (indicative of the operation of the ignition system's secondary) via terminal 82 (FIG. 5). The output of the OR gate 114 is coupled to the D input of a conventional flip-flop 116. The clock input of this flip-flop receives the waveform 50 after inversion by an inverter 118. The not Q output of the flip-flop 116 is coupled to one input of an AND gate 120, the other input of which is the waveform 50 received via lead 122. The output signal from the gate 120, referred to as M.C. (misfire control), appears at terminal 124 and is shown in FIG. 8 which reveals how the circuitry in FIG. 7 operates.

With reference to FIG. 8, it is assumed that no misfire condition existed prior to time T4. Under that circumstance, the signals E and M.C. are identical to waveform 50. At time T4, a fault is sensed because the primary ignition voltage sensed by the comparator 88 (FIG. 5) failed to exceed the 3.5 volt reference voltage. This fault could have been caused by a fault in the primary of the ignition system or for any other reason which keeps the primary ignition voltage from reaching its nominal value. Note that this is not the type of fault that was intended to be detected by the circuit 40 (FIG. 5). This causes the signal E to omit its next successive pulse. The signal M.C. also omits a pulse, but the omission is delayed from E by one cycle. Immediately after time T4, the fault condition disappears.

At time T5, the circuit 40 (FIG. 5) detects a misfire and drives the output terminal 82 high. The signal E is unaffected by the sensed misfire, but the signal M.C. responds by omitting a pulse in the next cycle.

At time T6, another fault is sensed in the primary winding (the same kind of fault as existed at time T4), plus the circuit 40 senses a misfire. This causes the signal B.T. to immediately omit a pulse, and the signal M.C. omits one of its pulses during the next cycle.

The significance of the signal M.C. is that it contains information enabling the misfiring cylinder to be identified. Remembering that the waveform 50 is the signal that controls ignition timing for each cylinder, the signal M.C. needs only to be compared to the waveform 50 to identify the cylinder or cylinders which are misfiring. That function is provided by the circuitry shown in FIG. 9, to which reference is now made.

Figure 9:
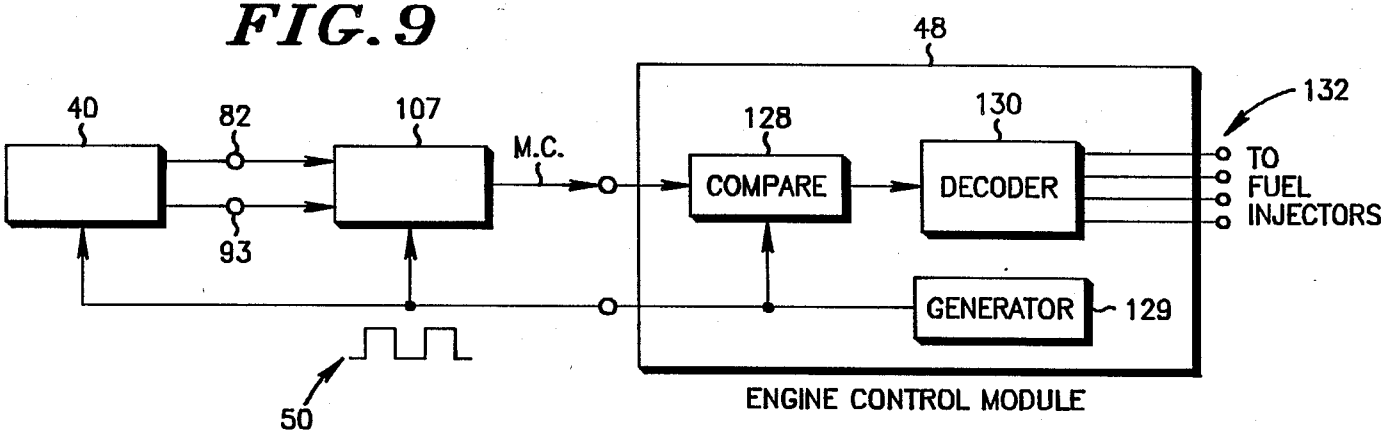
FIG. 9 shows a system, including the circuits shown in FIGS. 5 and 7, for inhibiting the flow of fuel to a misfiring cylinder.

As shown, the circuit 40 sends two signals to the circuit 107 via terminals 82 and 93. Both circuits 40 and 107 (which may be part of a larger ignition control module) receive the waveform 50 which is developed within the engine control module 48. The module 48 may be an EEC-IV module, made by Motorola, Inc., which is modified as discussed herein to interface with the circuits 40 and 107. Such modifications are shown in FIG. 9, with the remainder and non-illustrated part of the module being conventional.

As shown, the module 48 includes a conventional compare function indicated by block 128 and a conventional decoder 130. The compare block 128 compares the M.C. signal to the waveform 50, developed by a signal generator 129, to identify the cylinder, if any, that is misfiring. A signal identifying the misfiring signal is sent to the decoder 130 which determines which fuel injector to shut off (in a multi-injector) or for how long to shut off the sole injector (in a single point injector sYstem). In the illustrated embodiment, a four-injector system is assumed. Accordingly, four control lines, collectively numbered 132, couple a control signal developed by the decoder 130 to the appropriate fuel injector so as to shut down the flow of fuel to the cylinder that is misfiring.

Although the invention has been described in terms of illustrative embodiments, it will be obvious to those skilled in the art that various alterations and variations may be made without departing from the invention. Accordingly, it is intended that all such alterations and modifications be considered as within the spirit and scope of the invention as defined by the appended claims.

What is claimed is:

1. A method of detecting misfire due to a fault in the secondary of an automotive ignition system that includes at least one ignition coil having a primary winding for developing a primary ignition signal, comprising:

sensing the ignition coil's primary ignition signal;

comparing the sensed signal to a reference signal; and indicating a misfire condition when the compared primary ignition signal exhibits an abnormal relationship to the reference signal a first predetermined interval after the initiation of the primary ignition signal.

2. A method as set forth in claim 1, further including:

identifying the cylinder associated with the misfire; and shutting off the flow of fuel to the identified cylinder.

3. A method as set forth in claim 1 wherein the primary ignition signal is a primary ignition current, and wherein the step of indicating a misfire condition includes developing a latched misfire signal when the compared primary ignition current exceeds the reference signal, thereby indicating the presence of a shorted condition associated with the secondary of the ignition system.

4. A method of detecting misfire in an internal combustion engine that includes at least one ignition coil for developing a primary voltage, comprising:

sensing the ignition coil's primary voltage;

comparing the sensed primary voltage to a reference voltage to develop a control signal whose value is indicative of the relationship between the reference voltage and the sensed primary voltage;

integrating the control signal;

indicating a misfire condition if the value of the integrated control signal differs from a nominal value at a first predetermined time after initiation of the primary voltage; and indicating a misfire condition if the value of the control signal is indicative of an abnormal relationship between the reference voltage and the sensed primary voltage at a second predetermined time after initiation of the primary voltage.

5. In an internal combustion engine having a plurality of cylinders that receive fuel, and having an ignition system with at least one ignition coil that develops an ignition signal, a method for detecting misfire due to a fault in the secondary of the ignition system and for reducing the effects of misfire, comprising:

sensing the initiation of the ignition signal and generating a delayed signal a predetermined time thereafter, comparing the ignition signal to a reference signal;

generating a misfire signal in response to the delayed signal when the ignition signal exhibits an abnormal relationship to the reference signal;

identifying the cylinder associated with the misfire; and restricting the flow of fuel to the identified cylinder.

6. A circuit for detecting misfire due to a fault in the secondary of an automotive ignition system that includes an ignition coil having at least a primary winding for developing a primary ignition voltage, comprising:

means sensing the primary ignition voltage for generating a start signal;

means for establishing a reference voltage;

comparator means receiving the primary ignition voltage and the reference voltage for comparing the received voltages to each other and for developing a control signal whose value depends on the relative size of the primary ignition voltage;

means for integrating the control signal;

first delay means for delaying the start signal for a predetermined, relatively short, time interval;

second delay means for delaying the start signal for a predetermined, relatively longer, time interval;

first latch means coupled to the integrated control signal and responsive to the delayed start signal from the first delay means for developing a fault signal when the value of the integrated control signal has an abnormal value; and second latch means coupled to the control signal and responsive to the delayed start signal from the second delay means for developing a fault signal when the value of the control signal indicates that the primary ignition voltage is larger than the reference voltage.

7. A method of detecting misfire due to a fault in the secondary of an automotive ignition system that includes at least one ignition coil having a primary winding for developing a primary ignition signal, comprising:

comparing the primary ignition signal to a reference signal to develop a control signal whose value is indicative of the relative amplitude of the primary ignition signal;

integrating the control signal that exists a predetermined time after the initiation of the primary ignition signal;

comparing the integrated control signal to a second reference signal; and indicating a misfire condition when the integrated control signal exhibits an abnormal relationship to the second reference signal.

8. A method as set forth in claim 7, wherein the primary ignition signal is a primary ignition voltage which exhibits a pulse upon the initiation of the primary ignition voltage, and wherein said predetermined time is at least as long as the time required for said pulse to substantially dissipate.

9. A method of detecting misfire due to a fault in the secondary of an automotive ignition system that includes at least one ignition coil which generates a primary ignition voltage and a primary ignition current, comprising:

sensing the primary ignition voltage;

using the sensed ignition voltage to develop a further signal that is representative of the energy associated with the primary ignition voltage;

comparing the further signal to a reference;

generating a misfire signal if the further signal exceeds the reference;

comparing the primary ignition current to a second reference; and generating a misfire signal if the primary ignition current exceeds the second reference a predetermined time after initiation of the ignition current.

10. A method and set forth in claim 9, further including:

identifying the cylinder associated with the misfire; and shutting off the flow of fuel to the identified cylinder.

11. A circuit for detecting misfire due to a fault in the secondary of an automotive ignition system that includes at least one ignition coil having a primary winding for developing a primary ignition signal, comprising:

means for developing a reference signal;

means for comparing the reference signal to the primary ignition signal and for developing a control signal having at least first and second states that are indicative of the relative value of the ignition signal; and means responsive to the control signal for indicating a misfire condition when the control signal is in a first state after a predetermined interval following the initiation of the primary ignition signal.

12. A circuit as set forth in claim 11 wherein said means for indicating a misfire condition includes a flip-flop receiving the output of the comparing means, and means for clocking the flip-flop upon the expiration of the predetermined interval.

13. A circuit as set forth in claim 11, wherein the circuit is used with an engine having a plurality of cylinders that receive fuel, and further including:

means responsive to the indication of a misfire condition for selectively restricting the flow of fuel to the cylinders.

14. A circuit for detecting misfire due to a fault in the secondary of an automotive ignition system that includes at least one ignition coil having a primary winding for developing a primary ignition signal, comprising:

means for developing a reference voltage;

means for comparing the reference voltage to the primary ignition signal and for developing a control signal having at least first and second states that are indicative of the relative value of the ignition signal;

means for integrating the control signal;

first fault sensing means for sensing the value of the integrated control signal a first predetermined interval after the initiation of the primary ignition voltage and for generating a fault signal when the value of the integrated control signal is abnormal; and a misfire indicator responsive to the fault signal for generating a misfire signal.

15. A circuit as set forth in claim 14 further including second fault sensing means coupled to the fault indicator for sensing the value of the control signal a second predetermined interval after the initiation of the primary ignition voltage and generating a second fault signal when the value of the control signal is indicative of an abnormal relationship between the primary ignition voltage and the reference voltage, whereby the misfire indicator may generate a misfire signal in response to the second fault signal.

16. A circuit as set forth in claim 14 wherein said first fault sensing means includes:

means sensing the primary ignition voltage for generating a start signal;

means for delaying the start signal for said first predetermined interval; and latch means responsive to the delayed start signal and to the control signal for generating the fault signal.

17. A circuit for detecting misfire due to a fault in the secondary of an automotive ignition system that includes at least one ignition coil having a primary winding for developing a primary ignition voltage, comprising:

means for comparing the primary ignition voltage to a reference voltage to develop a control signal when the amplitude of the primary ignition voltage exceeds the amplitude of the reference voltage;

an integrator;

means for coupling the control signal to the integrator a predetermined interval after the initiation of the primary ignition voltage; and means for indicating a misfire condition when the integrated control signal exceeds a threshold voltage.

18. A circuit as set forth in claim 17 wherein the primary winding also develops a primary ignition current, and further including:

means for comparing the amplitude of the primary ignition current to a reference value, and for generating another control signal when the primary ignition current exceeds the reference value;

a flip-flop receiving the other control signal and having an output; and means for clocking the flip-flop a second predetermined interval after the initiation of the primary ignition current, such that the output of the flip-flop then signals a misfire condition when receiving the other control signal.

19. A circuit as set forth in claim 18, wherein the engine includes a plurality of cylinders that receive fuel, and further including:

means responsive at least to the misfire signal for developing a further signal for identifying a cylinder associated with the misfire; and means responsive to the further signal for restricting the flow of fuel to the identified cylinder.

20. A method of detecting misfire due to a fault in the secondary of an automotive ignition system that includes at least one ignition coil having a primary winding for developing a primary ignition signal, comprising:

(a) generating a signal that is representative of the energy associated with the primary ignition signal;

(b) sensing the level of the energy at a predetermined time after initiation of the primary ignition signal, and (c) indicating a misfire condition when the sensed energy level is abnormal.

21. A method as set forth in claim 20 wherein step (a) includes:

comparing the primary ignition signal to a reference signal to develop a control signal whose value is indicative of the relationship between the reference signal and the primary ignition signal; and integrating the control signal.

22. A method as set forth in claim 21 wherein said indicated misfire condition signifies a first type of fault, and further including:

indicating a further misfire condition when the compared primary ignition signal exhibits an abnormal relationship to the reference signal a second predetermined interval after the initiation of the primary ignition signal.

23. A method as set forth in claim 22 wherein the primary ignition signal is a primary ignition voltage, wherein the ignition coil normally develops the primary ignition voltage for an interval TA, wherein the first predetermined interval is less than TA and the second predetermined interval is greater than TA.

* * * * *